US009365985B2

(12) United States Patent
Nacke et al.

(10) Patent No.: US 9,365,985 B2
(45) Date of Patent: Jun. 14, 2016

(54) SELF-PROPELLED GROUND MILLING MACHINE FOR PROCESSING GROUND SURFACES HAVING A MILLING DEVICE

(71) Applicant: BOMAG GmbH, Boppard (DE)

(72) Inventors: Andreas Nacke, Dessighofen (DE); Andre Hoffmann, Gondershausen (DE); Timo Loew, Boppard (DE); Marco Reuter, Emmelshausen (DE)

(73) Assignee: BOMAG GmbH, Boppard (DE)

( * ) Notice: Subject to any disclaimer, the term of this patent is extended or adjusted under 35 U.S.C. 154(b) by 0 days.

(21) Appl. No.: 14/285,749

(22) Filed: May 23, 2014

(65) Prior Publication Data

US 2014/0348585 A1 Nov. 27, 2014

(30) Foreign Application Priority Data

May 24, 2013 (DE) ..... 10 2013 008 939

(51) Int. Cl.
*E01C 23/088* (2006.01)
*F02D 41/12* (2006.01)
(Continued)

(52) U.S. Cl.
CPC ..... *E01C 23/088* (2013.01); *F02D 29/02* (2013.01); *F02D 41/021* (2013.01); *F02D 41/12* (2013.01);
(Continued)

(58) Field of Classification Search
CPC ..... E01C 23/088; F16H 61/48; F16H 61/475; B60W 10/103; B60W 10/30; B60W 10/1886; B60W 10/023; F02D 41/021; F02D 41/12; F02D 29/02; F02D 2200/1002; F02D 2200/1004; F02D 2200/101; F02D 2400/12
See application file for complete search history.

(56) References Cited

U.S. PATENT DOCUMENTS 7,530,641 B2 * 5/2009 Berning ..... B28D 1/18 299/1.5
8,888,194 B2 * 11/2014 Killion ..... E01C 23/088 299/1.5

(Continued)

FOREIGN PATENT DOCUMENTS

DE 10 2010 014 893 A1 10/2011

OTHER PUBLICATIONS

Espacenet, English Machine Translation of Application No. DE102010014893A1, published Oct. 20, 2011, retrieved from http://worldwide.espacenet.com on May 22, 2014 (11 pages).

(Continued)

*Primary Examiner* — Abigail A Risic
(74) *Attorney, Agent, or Firm* — Wood, Herron & Evans, LLP

(57) ABSTRACT

The present invention relates to a self-propelled ground milling machine for treatment of ground surfaces by means of a milling device, a transportation means and a drive device for driving the transportation means and the milling device. The milling device is mounted on a ground milling machine frame and can be switched between a working position, in which the milling device is in operative contact with the ground surface and a maneuvering position, in which the milling device is not in operative contact with the ground surface. The drive device comprises a drive control unit, which controls the driving power of the drive device. The ground milling machine further comprises a ground milling machine control unit. The ground milling machine control unit controls the interaction of the drive device, the transportation means, and the milling device such that the driving power of the drive device in the maneuvering position of the milling device is automatically caused to be lower than the driving power of the drive device in the working position of the milling device while at least sufficient driving power for the transportation means is maintained.

14 Claims, 5 Drawing Sheets

(51) Int. Cl.
*F02D 29/02* (2006.01)
*F02D 41/02* (2006.01)

(52) U.S. Cl.
CPC ... *F02D 2200/101* (2013.01); *F02D 2200/1002* (2013.01); *F02D 2200/1004* (2013.01); *F02D 2400/12* (2013.01)

(56) References Cited

U.S. PATENT DOCUMENTS 9,016,798 B2 * 4/2015 Berning ..... E01C 23/088 299/1.5
2007/0286678 A1 * 12/2007 Berning ..... B28D 1/18 404/90
2008/0246328 A1 * 10/2008 Mannebach ..... E01C 21/00 299/39.6
2011/0266858 A1 11/2011 Laux et al.
2013/0103273 A1 * 4/2013 von Schonebeck ..... F16H 61/48 701/51
2013/0162003 A1 * 6/2013 Killion ..... E01C 23/088 299/1.5
2013/0249271 A1 * 9/2013 Killion ..... E01C 23/122 299/1.5

OTHER PUBLICATIONS

German Patent Office, Search Report for Application No. 10 2013 008 939.5, mailed Feb. 28, 2014 (4 pages).

* cited by examiner

SELF-PROPELLED GROUND MILLING MACHINE FOR PROCESSING GROUND SURFACES HAVING A MILLING DEVICE

CROSS-REFERENCE TO RELATED APPLICATIONS

The present application claims priority under 35 U.S.C. §119 of German Patent Application No. 10 2013 008 939.5, filed May 24, 2013, the disclosure of which is hereby incorporated herein by reference in its entirety.

FIELD OF THE INVENTION

The present invention relates to a self-propelled ground milling machine for processing ground surfaces. A generic ground milling machine comprises a transportation means, a milling device, and a drive device for the propulsion of the transportation means and the milling device. The milling device is directly or indirectly mounted on a chassis of the ground milling machine and can be switched between a working position, in which the milling device is in operative contact with the ground surface, and a maneuvering position, in which the milling device is not in operative contact with the ground surface. The maneuvering position is necessary, for example, when maneuvering of the ground milling machine is required, for example, when traveling to, or when at, the operating site. More particularly, the milling device comprises at least one milling drum, mounted directly or indirectly on the chassis, with its horizontal axis of rotation being transverse to the direction of advance, a milling drum enclosure, for example, in the form of a milling drum box or a milling drum hood, and a drive train, the purpose of which is to convey the drive energy required to operate the milling drum to the milling drum. The transportation means likewise disposed on the chassis comprises, in particular, traveling means, for example, wheels and/or crawler tracks, enabling the ground milling machine to travel on the ground.

BACKGROUND OF THE INVENTION

Such a ground milling machine is known, for example, from DE 10 2010 014 893 A1, to which reference is expressly made herein. A sensor device is disclosed therein for such a ground milling machine, for the purpose of detecting the maneuvering position and/or at least one working parameter of the milling device, that is to say, its energy consumption, working speed, speed of rotation, inclination, and/or at least one loading parameter of the transportation means. Furthermore, a control device is provided, which is adapted to reduce the flow of force between the drive device and the milling device in the maneuvering position and/or upon detection of a discrepancy of the at least one detected working parameter or loading parameter from a setpoint value, or decrease the drive energy per unit of time (the driving power) conveyed to the milling device by means of a dynamic torque converter.

Thus, the driving power of the drive device itself can be maintained at a high and virtually consistent level in all positions of the milling device, thus enabling rapid switching from the operating phase to the maneuvering phase, and vice versa. To this effect, the driving device is generally operated steadily and under maximum power. A reduction of the drive energy transferred to the milling device is achieved by way of friction losses occurring in the dynamic torque converter in the form of, for example, a multi-disc clutch exhibiting adjustable slippage caused by varying the pressure on the disc pack, by means of which the drive energy ultimately applied to the milling device, as compared with the drive device running under high driving power, is reduced due to friction losses.

It is an object of the present invention to create a self-propelled ground milling machine having a milling device and showing improved regulation of the driving power over the prior art.

SUMMARY OF THE INVENTION

A generic ground milling machine comprises a transportation means, a milling device, and a drive device for the propulsion of the transportation means and the milling device. The milling device is disposed on a ground milling machine chassis and can be switched between a working position, in which the milling device is in operative contact with the ground surface, and a maneuvering position, in which the milling device is not in operative contact with the ground surface. The drive device, more particularly, a combustion engine, comprises a drive control unit adapted to control the driving power of the drive device. By "driving power" is meant the drive energy per unit of time available on the output shaft of the combustion engine. In particular, the drive control unit is thus an engine control unit adapted, in particular, to control solely the processes relating to the drive device. According to the present invention, provision is made for a ground milling machine control unit to be present in addition to the drive control unit. The ground milling machine control unit controls the cooperation between the drive device, the transportation means, and the milling device in such a way that the driving power of the drive device in the maneuvering position of the milling device is automatically reduced in relation to the driving power of the drive device in the working position of the milling device, whilst maintaining at least sufficient power for the transportation means. According to the present invention, the driving power provided by the drive device for the maneuvering mode, during which the milling device is in maneuvering position, is lower than the driving power provided for the operational mode, during which the milling device is in the working position, this power reduction being such that at least a reliable traveling operation is still possible. At the same time, however, the driving power should ideally be decreased to a point at which propulsion of the milling device with the milling drum touching the ground is no longer possible, as would result, for example, in a combustion engine shutdown. Due to the comparatively low driving power available during a maneuvering operation, the present invention thus provides for the ground resistance acting against the milling drum if touching the ground to be sufficient to stop rotary movement of the milling drum. This reliably ensures, for example, that the ground milling machine is not, when the milling drum touches the ground, undesirably moved due to the rotation of the milling drum. In particular, unlike the variants previously described in the prior art, the present invention provides power reduction for the maneuvering operation at a central point of the overall drive system, that is to say, directly at the drive device, more particularly, the drive engine, and not by force or power transmitting means, for example, a clutch. The basic concept of the present invention thus provides for the drive energy per unit of time, as is basically available for the entire ground milling machine, or, more particularly, the driving power developed by the drive device, to be wholly reduced for the maneuvering operation, for example, by reducing the fuel input.

This self-propelled ground milling machine incorporating a milling device has the advantage that rapid switching between operating phase and maneuvering phase is possible when milling ground surfaces, with the result, for example, that a road surface can be milled quickly along adjacent strips having the width of a milling tool. The advantages of the present invention become most apparent when fine milling is carried out, during which the milling drum operates at a particularly high speed, with the result that the present invention is particularly suitable for use in road milling machines. The present invention can, however, fundamentally also be utilized in ground milling machines designed as recyclers and/or stabilizers. The force flow between the drive device and milling device is, according to the present invention, not broken in any of the operational phases or separately reduced. Instead, the driving power of the drive device is reduced, that is to say, control intervention occurs directly at the drive device, more particularly, by appropriately controlling the engine control unit by means of the ground milling machine control unit. This can specifically take place, for example, by regulating the fuel injection rate, which is accordingly reduced for the purpose of reducing the driving power of the drive device and vice versa. In all, according to the present invention, the driving power of the drive device is restricted or, more particularly, its output power is restricted in such a way, that it is essentially limited to at least the traveling performance required for the maneuvering operation. The drive device needs to apply only that driving power that is absolutely necessary for rapid operation, both in the maneuvering phase and in the operating phase, or, more specifically, according to whether the milling device is in the working position or in the maneuvering position.

For faultless functioning of the present ground milling machine, a device is thus also required by means of which the ground milling machine control unit can distinguish between the maneuvering phase, or, more particularly, the phase in which the milling device is located in a maneuvering position, and the working/milling phase, or, more particularly, the phase in which the milling device is located in a working position. In the simplest case, this can be effected, for example, by means of a direction sensor. In addition, or alternatively, provision may be made for the adjustment position of the milling drum and/or other relevant parameters to be ascertained and relayed to the ground milling machine control unit. Furthermore, it is possible for the reduction in driving power to be determined manually by the driver, for example, by means of a switching device enabling switching between working or milling operation and maneuvering operation.

The drive device preferably applies maximum driving power in the working position of the milling device, for example, controlled by means of the ground milling machine control unit. Furthermore, provision is made for the drive device in the maneuvering position of the milling device to apply a fraction of the maximum driving power, which fraction is at least sufficient to provide driving power for the transportation means and for any implements that may have to be driven during a maneuvering phase. Thus, it can advantageously be assumed that the driving power for the transportation means and for implements that have to be driven during the maneuvering phase is less than one half, or, more particularly, less than one third, of the maximum driving power, with the effect that, on reduction of the maximum driving power to one third, the milling tool remains in rotation and does therefore not stop when changing from the working position to the maneuvering position and while in the maneuvering operation. The fraction of driving power applied by the drive device when the milling device is in the maneuvering position is thus equal to preferably less than 50%, more particularly, less than 40% and, most particularly, less than 30% of the maximum driving power of 100%. The driving power required for the transportation means defines that percentage of the maximum driving power of 100% that is required for driving the ground milling machine, especially with a milling device in maneuvering position. This is, in other words, equivalent to the driving power required for moving the ground milling machine through propulsion of the transportation means under normal maneuvering conditions. Accordingly, the percentages as given above imply that a substantial percentage of the maximum driving power of the drive device is required, in the operational mode, for the propulsion of the milling device.

Since it is not necessary to convey any material on a conveyor for milled material during the maneuvering phase, the driving power for the conveyor for milled material can also be conserved in the maneuvering phase. This fundamentally applies to all implements required only in the operational mode of the ground milling machine, with the milling device in the working position. Other implements are, however, also required during the maneuvering operation, for example, the lifting devices between the ground milling machine frame and the chassis, as well as between the ground milling machine frame and the milling device. In this regard, care must be taken to ensure that sufficient driving power is available to guarantee that, in the maneuvering phase, too, leakages are compensated for and that lifting maneuvers can be carried out, as may be required, for example, in the transition regions between the unmilled ground surface to the milled ground surface, or in the case of the ground being uneven.

It is generally possible and, furthermore, preferable for the ground milling machine control unit to control power reduction solely by means of a control parameter of the engine control unit, for example, by reducing the fuel injection rate. Thus, as soon as maneuvering commences, the ground milling machine control unit begins to regulate the engine control unit, for example, by controlling it in a suitable manner. Additionally, or alternatively, provision may, however, also be made for the milling device to comprise a speed sensor for cooperation with the ground milling machine control unit. The ground milling machine control unit controls the reduction of driving power of the drive device in the maneuvering position of the milling device to such extent, that the milling device speed drops to a fraction of the speed of the milling device used in the working position, without, however, dropping below a driving power suitable for the transportation means and for any implements to be powered. This embodiment of the present invention ensures that the milling device or, more particularly, the milling tool is not fully deactivated, even though in the maneuvering position, with the effect that, on commencement of the operating phase, it is merely necessary to accelerate to the working speed of the milling tool. In this regard, complete deactivation of the milling tool is prevented, thus avoiding time consuming coupling procedures when switching between the operating and maneuvering phases, and vice versa, when milling ground surfaces.

A preferred embodiment of the present invention is designed such that a dynamic torque converter is disposed in the drive train between the drive device and the milling device, cooperating with the ground milling machine control unit and reducing the drive torque for the milling device from maximum torque to minimum torque when switching from the working position to the maneuvering position. However, such a dynamic torque converter is not intended to replace the reduction in driving power of the drive device in the self propelled ground milling machine according to the present invention. The purpose of the dynamic torque converter is rather to protect the milling tool from any damage that might occur when, in a maneuvering phase, the milling tool, with its driving power already reduced, should unexpectedly be prevented from rotating by an unforeseeable obstruction.

During the operating phase, the direction of rotation of the milling tool is contrary to the direction of rotation of the chassis of the transportation means. In the maneuvering phase, during which the ground milling machine is returned to a starting point for the purpose of milling a further section of the ground surface, the direction of rotation of the milling tool and the direction of rotation of the transportation means are generally the same, posing the risk of the milling tool unexpectedly coming in contact with the ground, which could result in uncontrolled movement of the ground milling machine in the event of unexpected engagement of the milling tool with the ground surface, for example, on an extremely uneven ground surface or when moving from milled to unmilled ground surfaces. This is prevented by the reduction of the driving power of the drive device in the ground milling machine, which controls and reduces the driving power of the drive device in such a way, that it is not sufficient to cause rotation of the milling drum contrary to the resistance offered by the ground surface. For the purpose of making it possible to stop rotation of the milling drum as reliably and quickly as possible, a further development of the ground milling machine has proven to be advantageous in this regard, in which the drive device is provided with an emergency clutch throw-out means, and the milling device with a load torque sensor and/or rotary speed sensor. To this end, the ground milling machine control unit cooperates with the emergency clutch throw-out means of the drive device and the load torque sensor and/or the rotary speed sensor in such a way that when the load torque limit is exceeded and/or the rotary speed of the milling drum, ideally abruptly, drops below the threshold value in a maneuvering phase with the milling device in the maneuvering position, the ground milling machine control unit activates an actuator for the emergency clutch throw-out means. This embodiment is characterized in that the milling tool is further decoupled from the drive train, as a precaution, in the event of mechanical overloading and/or an abrupt drop in rotary speed, for example, when the milling drum unintentionally contacts the ground surface. Furthermore, in addition, or as an alternative, deactivation of the drive device can be provided for in the event of the load torque sensor of the milling device exceeding a load torque limit and/or the rotary speed sensor dropping below a rotary speed threshold. In such an emergency, the entire ground milling machine comes to a standstill. Furthermore, provision can also be made for the emergency clutch throw-out means to be actuated manually when the drive device needs to be switched off in an emergency situation, independently of an operating phase, so as to stop the ground milling machine.

It is preferred for the ground milling machine control unit to comprise a power control unit in cooperation with the drive control unit, such that the reduced driving power available in the maneuvering position of the milling device can be distributed over the powered implements of the ground milling machine required in a maneuvering operation, while the maneuvering operation is maintained.

According to a further aspect, the present invention relates to a method for operating a self-propelled ground milling machine comprising a transportation means, a milling device, and a drive device for propulsion of the transportation means and the milling device, for the purpose of treating ground surfaces by means of the milling device. In a working position, the milling device is in operative contact with the ground surface, and in a maneuvering position the milling device is not in operative contact with the ground surface. This method comprises the following method steps.

Method step a) consists of lowering the milling device in the starting position of an operating phase from a maneuvering position. In the operational mode that follows, milling of the ground surface takes place by means of the drive device applying maximum driving power to propel the ground milling machine, while at the same time milling a first section of the ground surface to the width of a milling tool of the milling device, to a final position of a first road section. In this phase, the drive device is usually operated at maximum driving power to achieve maximum milling power.

Since the width of the ground surface in a first road section often exceeds the width of the milling tool, this operating phase is followed by a maneuvering phase. In method step b) that follows, provision is therefore made for the milling device to be raised to a maneuvering position whilst the driving power of the drive device is also significantly reduced for the maneuvering operation in this maneuvering phase, in particular to a driving power of less than 50%, more particularly, of less than 40% and, ideally, of less than 30% of the maximum driving power of 100%. In the course of this operation, the self-propelled ground milling machine is moved back with the aid of the transportation means to the starting position under reduced driving power of the drive device while at the same time being laterally shifted into position for milling along a second, adjacent milling strip.

Steps a) and b) are then repeated until the desired width of the road section has been reached, possibly alternating between steps a) and b) a number of times.

Such a method has the advantage that the driving power of the drive device is reduced to a necessary minimum in each maneuvering phase for the purpose of driving the transportation means and supplying driving power to the implements required during the reverse movement of the ground milling machine. At the same time, power is reduced preferably to at least such a degree that the milling drum interlocking with the ground surface during this maneuvering phase will not, or only minimally, cause milling of the ground, but is instead arrested thereby. Consequently, regular milling operation is not possible under these conditions. For this reason, on the one hand, switching between the operating phase and the maneuvering phase is always possible without delay, since decoupling of the milling tool in the maneuvering phase and recoupling when shifting into the working phase are no longer required, and, on the other hand, the energy efficiency of the ground milling machine can be increased due to the drive device applying reduced, but sufficient, driving power during a maneuvering operation.

In a further exemplary implementation of the method, the fuel supply to the drive device comprising an internal combustion engine is automatically restricted to lower the driving power to at least that required by the transportation means, more particularly, by activation of an engine control unit by means of a ground milling machine control unit.

In a further exemplary implementation of the method, the milled material is simultaneously discharged during the operating phase via a front mounted and/or rear mounted discharge conveyor that can be switched off during the maneuvering phase to save energy, for the purpose of further favorably reducing the generation of driving power by the drive device. In addition, or as an alternative, this of course also applies to further implements requiring a supply of operating energy to some extent during the maneuvering and/or operational modes.

A further exemplary implementation of the method makes provision for registration of the rotary speed of the milling device and for regulation of the reduction of driving power in the maneuvering position of the milling device by means of a drive control unit, such that the rotary speed of the milling device is lowered to a fraction of the rotary speed of the milling device used in the working position without dropping below the maximally required driving power for the transportation means. Such maximally required driving power for the transportation means is significantly lower than the maximum driving power of the drive device and gains relevance when switching from the operating phase to the maneuvering phase. In such a switching operation, the self-propelled ground milling machine must be accelerated, as described above, from a forward movement to a rearward movement and conversely from a rearward movement to a forward movement. Although such accelerating operations demand a maximal driving power for the transportation means, this is significantly lower than the maximum possible driving power of the drive device.

A preferred development of the method according to the present invention makes provision for a dynamic torque converter positioned between the drive device and the milling device to be controlled by the ground milling machine control unit, which dynamic torque converter reduces the drive torque transmission for the milling device from a maximum torque transmission to a minimum torque transmission when changing from the working position to the maneuvering position. The purpose of such reduction of the torque transmission is, however, not to replace the reduction in driving power of the drive device when changing from the operating phase to the maneuvering phase, but is instead to provide an additional guarantee that the milling tool will not be damaged when accidental resistance acting against the rotating milling tool in the maneuvering position occurs, since the torque transmission to the milling tool is minimized to such extent, that the milling tool can come to a standstill without being damaged.

A further exemplary implementation of the method makes provision for the registration of a load torque on the milling device and/or of the rotary speed of the milling drum of the milling device (or, additionally or alternatively, of some other rotating element in the drive train towards the milling drum), and that, when the load torque limit of the milling device is exceeded and/or when the rotary speed limit falls below the threshold value in the maneuvering position, the ground milling machine control unit activates an actuator for an emergency clutch throw-out means of the drive device by way of the engine control unit. This method has the advantage that not only does the milling tool come to a standstill, as described above with the use of a dynamic torque converter, but also the entire self-propelled ground milling machine comes to a standstill. Such emergency clutch throw-out means for the drive device can also be actuated by a manual emergency shut-down switch connected in series for the purpose of enabling the operator to bring the ground milling machine to a halt in an emergency situation.

BRIEF DESCRIPTION OF THE DRAWINGS

The present invention is described below with reference to the exemplary embodiments explained in detail with reference to the figures, in which.

DETAILED DESCRIPTION OF THE INVENTION

Figure 1:
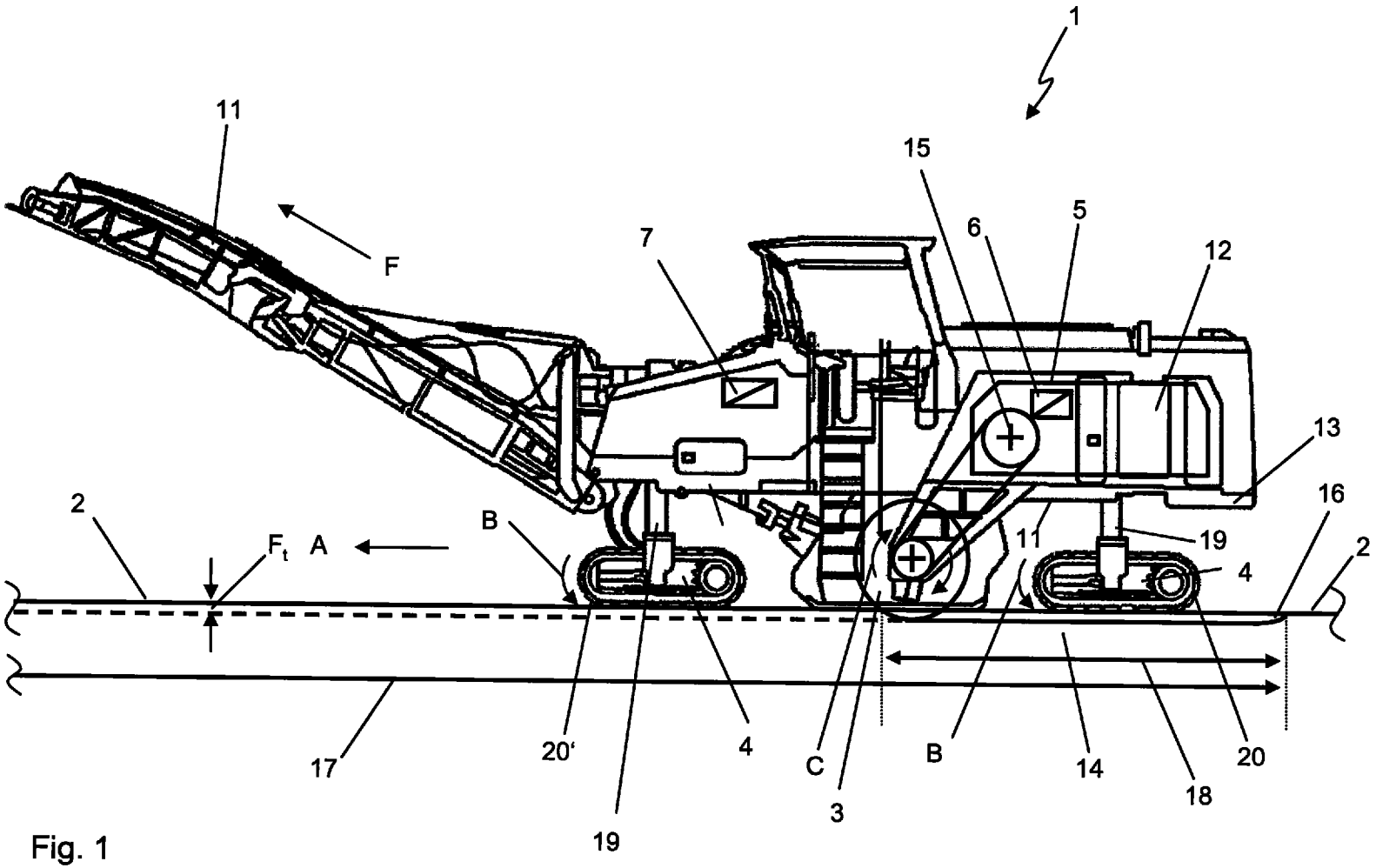
FIG. 1 is a diagrammatic view of a self-propelled ground milling machine for the treatment of ground surfaces by means of a milling device in the working position during an operational phase.

FIG. 1 is a diagrammatic view of a self-propelled ground milling machine 1 for the treatment of ground surfaces 2 by means of a milling device 3 during an operational phase. During such an operational phase, the ground milling machine 1 is moved in the direction of the arrow A with the aid of transportation means 4, while the milling device 3 comprising a rotating milling tool 9 is set in a working position, in which the milling tool 9 removes material from the ground surface 2 down to a milled surface 14, the milling depth $F_t$ being adjustable. For the purpose of adjusting the milling depth $F_t$, the milling tool 9 of the milling device 3 is mounted on a ground milling machine frame 13 for pivotal movement about, say, a drive axis 15 of a drive shaft, or, as shown in the present exemplary embodiment, is vertically adjustable by means of lifting columns 19 connecting the frame to the individual crawler tracks of the transportation means 4.

In this embodiment of the present invention, the drive shaft is a crankshaft of a drive device 5, in this case designed as a combustion engine 12. The drive device 5 is controlled by a drive control unit 6 in cooperation with a ground milling machine control unit 7. The ground milling machine control unit 7 coordinates propulsion by means of the transportation means 4 relative to the rotation speed or angular speed of the rotating milling tool 9, the direction of rotation of the transportation means 4 in the direction of the arrow B being contrary to the direction of rotation of the milling tool 9 in the direction of the arrow C. During a milling operation, the angular speed of the milling tool 9 is a multiple of the angular speed of the transportation means, the latter serving only for advancement in the direction of the arrow A.

The driving power applied by the drive device 5 in the operational phase, for the purpose of achieving maximum milling advance, is equivalent to a maximum driving power of 100%.

Figure 2:
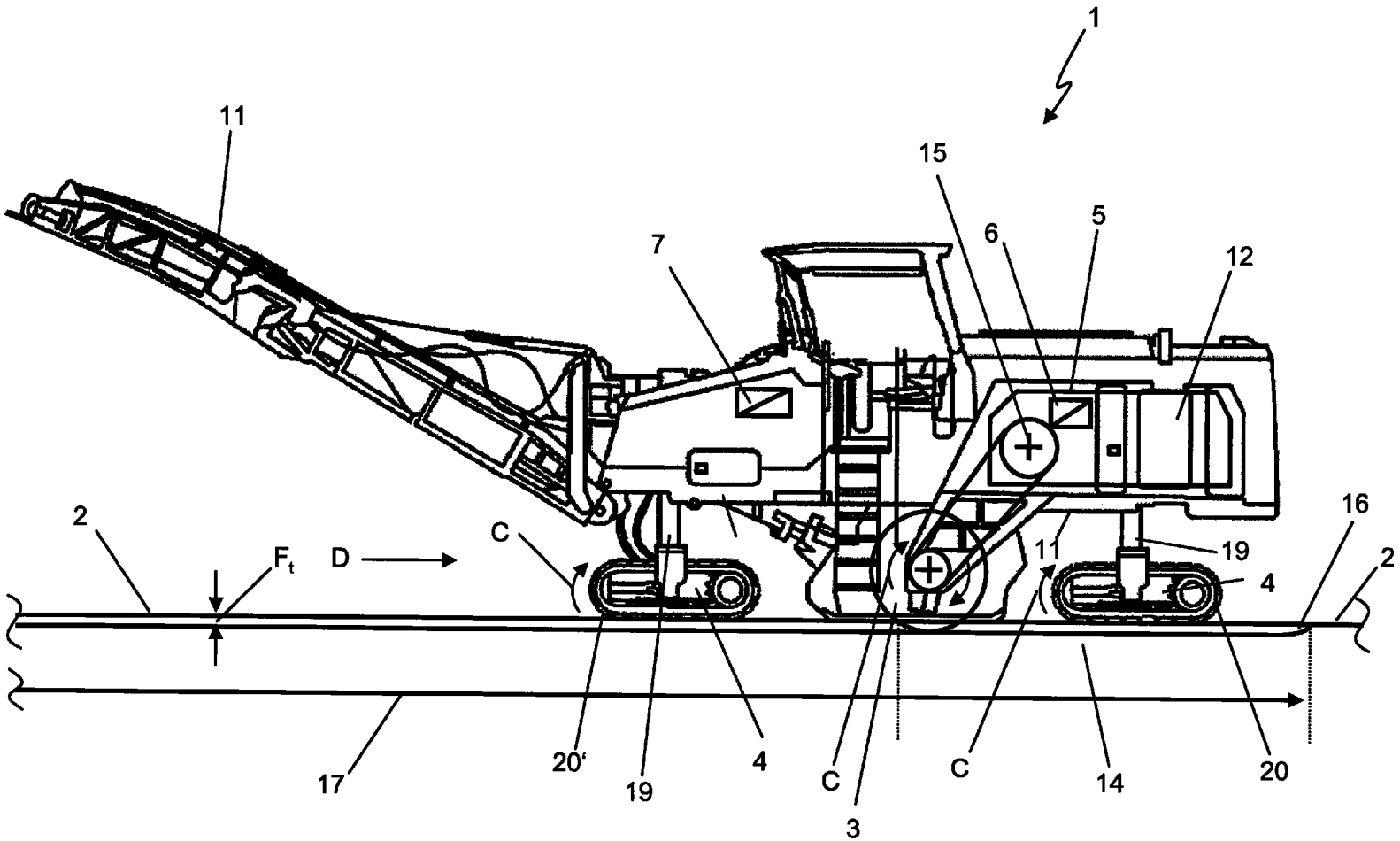
FIG. 2 is a diagrammatic view of the ground milling machine as shown in FIG. 1 with the milling device in the maneuvering position during a maneuvering phase.

FIG. 1 depicts a situation in which a small portion 18 of a strip of a road section 17 to be milled has been milled off, starting from a starting position 16, and with the aid of a front mounted discharge conveyor 11 dispatched in the direction of the arrow F. Once the final position (not shown) of this road section 17 has been reached and thus a first strip of the ground surface 2 has been milled off, the milling tool 9 is swiveled from the working position of the milling device 3 as shown here into a maneuvering position, or, as indicated in FIG. 2, the milling device 3 is raised from the ground by actuation of the lifting columns 19, for the purpose of disengaging the milling drum from the ground. At the same time, provision is made, according to the present invention, for the maximum driving power of the drive device 5 as required in the operational phase to be significantly reduced by way of appropriate activation of the drive control unit 6 by means of the ground milling machine control unit 7 in the maneuvering phase, without completely decoupling the milling tool from the drive device 5. Instead, the milling drum 9 continues to rotate in the direction of rotation C, albeit with reduced applied driving power.

As FIG. 2 shows, the ground milling machine 1 is returned, in the direction of the arrow D, to its starting position 16 in the maneuvering phase as shown, while at the same time the ground milling machine 1 is transversely offset for the purpose of removing a strip of the ground surface 2 adjacent to the strip shown in FIG. 1. This maneuvering phase, as shown in FIG. 2, is necessary if the width of the milling tool 9 is less than the width of the road section 17 to be processed. When returning in the direction of the arrow D as described above, only the transportation means 4 and the implements, such as hydraulic pumps, need to be supplied with driving power.

The driving power will be reduced down to a point at which the milling tool 9 will not continue to rotate when the milling device disposed in the maneuvering position is accidentally obstructed, for example, in case of ground unevenness or the presence of obstacles, thus preventing the ground milling machine 1 from jumping forward uncontrollably in the direction of the arrow D under the driving force of the milling drum. This consequently ensures safe guidance of the ground milling machine 1 despite continued rotation of the milling tool 9 during the maneuvering phase.

Hydraulic lifting columns 19 are disposed between the ground milling machine frame 13 and the transportation means 4, more particularly, to facilitate height adjustment in the event of one or more of the rearward crawler tracks 20 or forward crawler tracks 20' riding on different levels on the ground surface, for example, on the milled surface 14 and on the original ground surface 2. Furthermore, the ground milling machine frame 13 can be vertically adjusted with the aid of the lifting columns 19, consequently adjusting the milling depth $F_t$.

On account of the fact that in the maneuvering phase, as shown in FIG. 2, no milled material is produced, the driving power can be reduced to such an extent as to also switch off the milled material conveyor 11.

Figure 3:
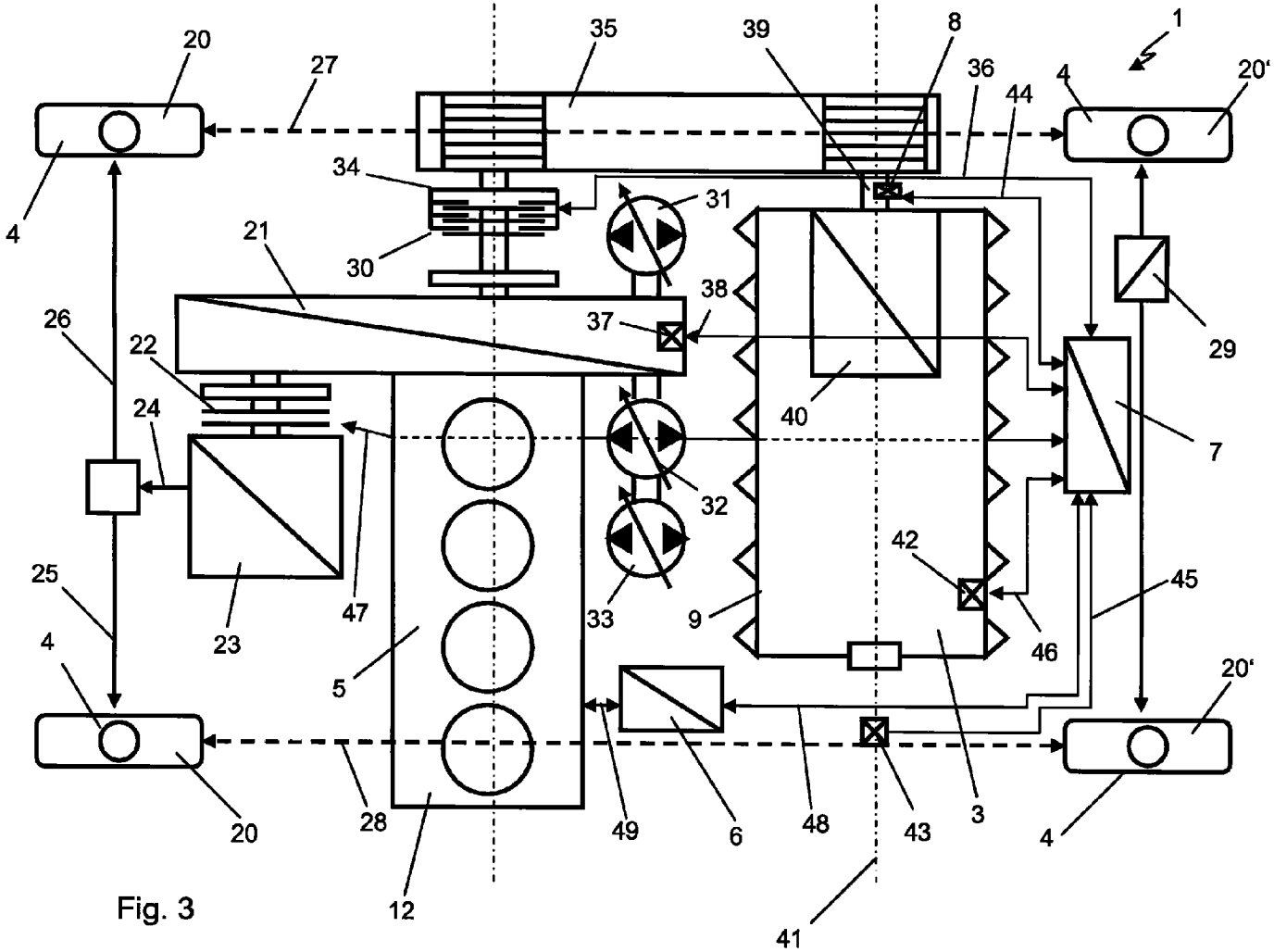
FIG. 3 is a diagrammatic sketch of components of a ground milling machine comprising a milling device according to one embodiment of the present invention.

FIG. 3 shows a diagrammatic sketch of components of a ground milling machine 1 comprising a milling device 3 according to an exemplary embodiment of the present invention. The main components of the ground milling machine 1 are the milling device 3, the transportation means 4, and the drive device 5. The driving power of the drive device 5, in this case in the form of a four-cylinder internal combustion engine 12, is transmitted via a transfer gearbox 21 and a transmission 23 by way of mechanical connections 24, 25, and 26, to at least two rearward crawler tracks 20 of the transportation means 4, the two forward crawler tracks 20' also being driven, as indicated by the mechanical connections 27 and 28 represented by dashed lines. The forward crawler tracks 20' are interlinked via a steering gear 29.

Connected to the transfer gearbox 21 are the transmission 23 and a plurality of pumps 31, 32, and 33. For the purpose of monitoring the pumps 31, 32, and 33, a number of pressure sensors 37 can be disposed within the transfer gearbox 21 and connected to the ground milling machine control unit 7 via signal conductors 38.

A large proportion of the driving power is transmitted through the transfer gearbox 21, a clutch device 30 and a belt transmission 35 to the milling tool 9 of the milling device 3. More particularly, the clutch device 30 comprises a multi-disc clutch, the pressure plate 34 of which is capable of applying variable degrees of pressure to the friction discs. The pressure plate 34 is appropriately actuated by the ground milling machine control unit 7 via a control line 36.

Rotation of the milling tool 9 is monitored by three sensors 8, 42, and 43, that is to say, by a rotary speed sensor 8 on the input shaft 39 of a milling tool transmission 40, a load sensor 43 on the axle 41 of the milling tool 9, and an angular speed sensor 42 for detection of the angular speed of the milling tool 9.

Connected to the ground milling machine control unit 7 are the rotary speed sensor 8 via a signal line 44, the load sensor 43 via a signal line 45, and the angular speed sensor 42 via a signal line 46.

In order to actuate the emergency clutch throw-out means 22, the ground milling machine control unit 7 comprises a control line 47 for the purpose of exchanging control data. In particular, for the purpose of lowering the driving power of the drive device 5, the ground milling machine control unit 7 is connected to a drive control unit 6, more particularly, an engine control unit, via a control line 48, which drive control unit 6 is in turn connected to the drive device 5 via a control line 49 and is solely responsible for controlling the operation of the drive device.

With the aid of the components of the ground milling machine 1, as illustrated in FIG. 3, it is now possible to reduce the driving power in a controlled and specific manner during a maneuvering phase to such an extent, that the transportation means 4, and, depending on the current application, the pumps 31, 32, and 33, continue to receive sufficient operational driving power or drive energy per unit of time, for the purpose of, say, enabling the operation of the ground milling machine 1, more particularly, during the maneuvering operation. On the other hand, there is the possibility of swiftly switching to maximum driving power without delay when the operational phase is required. Furthermore, the sensors 8, 42, and 43 that automatically monitor the milling tool during the operational phase and, more particularly, during the maneuvering phase, prevent damage to the milling tool in each operational phase. What is essential is that, in particular, the milling drum can continue operation during the maneuvering phase, so as to avoid the necessity, in particular, of constantly coupling and decoupling.

Figure 4:
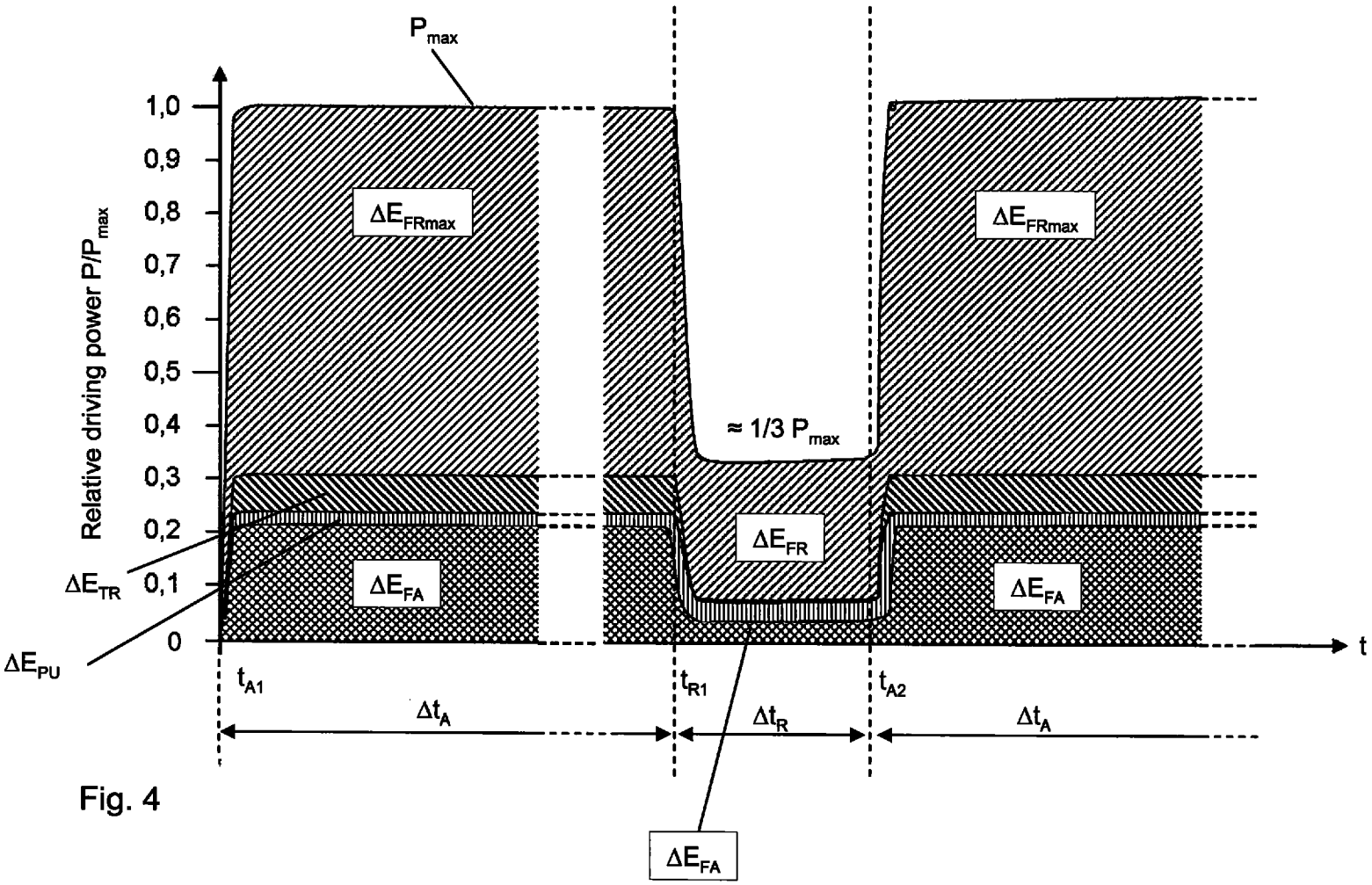
FIG. 4 is a graph illustrating the distribution of driving power and energy consumption during an operational phase and a maneuvering phase.

FIG. 4 is a diagram illustrating the distribution of driving power and energy consumption during an operational phase $\Delta t_A$ and during a maneuvering phase $t_R$ of a ground milling machine, as shown in FIGS. 1 to 3. For this purpose, the time t is plotted on the abscissa and a relative driving power $P/P_{max}$, on the ordinate, the latter being based on the maximum possible driving power of the drive device.

At a starting time $t_{A1}$, this maximum power splits during the operational phase $\Delta t_A$ into a propulsion power FA, a pump driving power PU, a conveyor driving power TR, and a milling driving power $FR_{max}$. Accordingly, FIG. 4 denotes the respective proportions of energy consumption $\Delta E$ by means of appropriate indices.

During the operational phase $\Delta t_A$, the ground surface is milled and the milled material is concurrently dispatched via the conveyor 11 as shown in FIGS. 1 and 2. Thus, the energy provided by the drive device during the timespan $\Delta t_A$ of the operational phase, is split up into a travel energy fraction $\Delta E_{FA}$, a pump energy fraction $\Delta E_{PU}$, a conveyor belt energy fraction $\Delta E_{TR}$, and a maximum milling energy fraction $\Delta E_{FRmax}$, as is illustrated by the areal fractions below the driving power curve in FIG. 4.

Once the operational phase $\Delta t_A$ is completed for the first time at the time $t_R$, and milling and the dispatch of the ground surface for a road section 17 is complete, the driving power in the subsequent maneuvering phase $\Delta t_R$ can be significantly reduced, as indicated in FIG. 4. As an example, in the diagram shown in FIG. 4, the driving power of the drive device is reduced in the maneuvering phase $\Delta t_R$ to about one third of the maximum driving power ⅓ $P_{max}$, which is entirely sufficient to maintain the traveling operation and pumping operations, and in addition to enable rotation of the milling tool.

Here again, in this maneuvering phase $\Delta t_R$, the areas below the driving power curves represent the energy consumption, as designated by $\Delta E_{FA}$ for the transportation means, by $\Delta E_{PU}$ for the pumps, and by $\Delta E_{FR}$ for the significantly reduced energy consumption of the milling tool. Since, as described above, the dispatch of milled material can be discontinued during the maneuvering phase $\Delta t_R$, the energy consumption therefore tends towards zero. Moreover, the energy consumption $\Delta E_{FA}$ of the transportation means can decrease marginally, as the transportation means is not required to advance the contra-rotating milling tool. Nonetheless, despite a reduction in the driving power of the drive device, there remains sufficient energy to cause an idling milling tool to rotate at a reduced speed during the maneuvering phase $\Delta t_R$.

This diagram clearly demonstrates the amount of energy that can be saved by reducing the driving power of the drive device during the maneuvering operation $\Delta t_R$. It should be noted that the driving power curves, as shown here, merely serve to illustrate the concept of the present invention, and do not represent absolute energy conservation values. This is further illustrated by the fact that, in reality, the timespan covering the operational phase $\Delta t_A$ is significantly longer than the timespan covering the maneuvering phase $\Delta t_R$, particularly because the speed of advance during the operational phase $\Delta t_A$ is significantly lower than the speed of return during the maneuvering phase $\Delta t_R$.

Although an exemplary embodiment has been described above, it is still possible to carry out a number of changes and modifications. The said embodiment is merely an exemplary embodiment and is not intended to restrict the scope, the applicability, or the configuration in any way. Instead, the above description provides the person skilled in the art with a scheme for implementation of the exemplary embodiment, and numerous alterations can be made to the function of the said exemplary embodiment, without departing from the scope of the appended claims and their legal equivalents.

Figure 5:
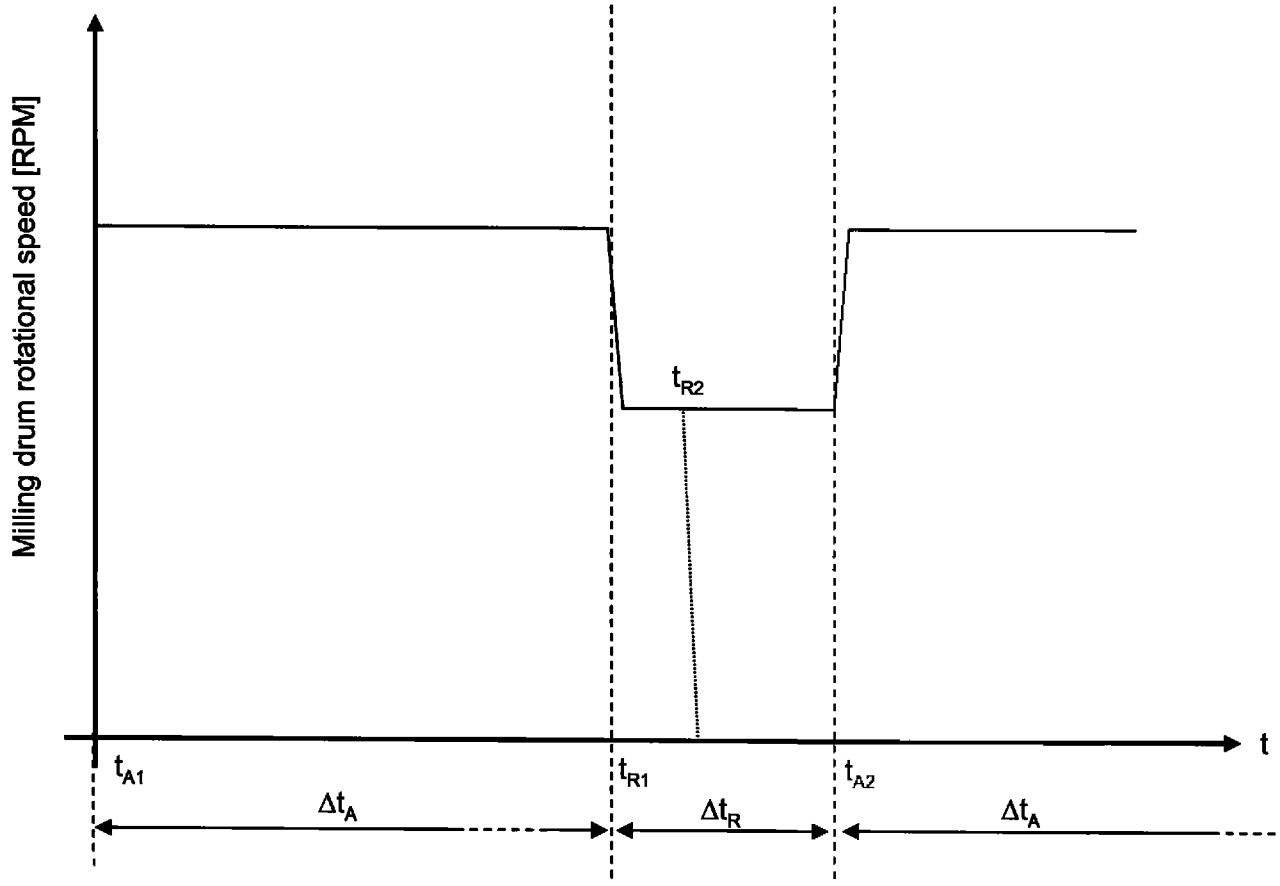
FIG. 5 is a speed graph of the milling drum.

Finally, FIG. 5 illustrates the effect on the milling drum 9 caused by the reduction in driving power. Firstly, depicted as a solid line, is a characteristic speed profile, the timescale being the same as that described with reference to the embodiments shown in FIG. 4. What is essential in this regard is that the milling drum speed decreases with application of reduced driving power during the maneuvering operation (chronologically to $\Delta t_{R1}$). The milling drum however continues to rotate.

Alternatively, at the time $\Delta t_{R2}$, the milling drum 9 unintentionally engages the ground while maneuvering, for example, while driving over an obstacle. Due to the low driving power applied during the maneuvering operation, the rotational speed of the milling drum 9 drops abruptly to zero, as is shown in the present exemplary embodiment, due to the milling drum being, in effect, locked by the ground and there not being sufficient driving power available to drive the milling drum into the ground. Any possible damage caused to the milling drum is therefore minimal. Furthermore, no movement of the ground milling machine occurs due to the milling drum engaging the ground in the direction of rotation of the milling drum.

While the present invention has been illustrated by description of various embodiments and while those embodiments have been described in considerable detail, it is not the intention of Applicant to restrict or in any way limit the scope of the appended claims to such details. Additional advantages and modifications will readily appear to those skilled in the art. The present invention in its broader aspects is therefore not limited to the specific details and illustrative examples shown and described. Accordingly, departures may be made from such details without departing from the spirit or scope of Applicants' invention.

What is claimed is:

1. A self-propelled ground milling machine for treating ground surfaces, comprising:

a transportation means, a milling device and a drive device for driving said transportation means and said milling device, said milling device being disposed on a ground milling machine frame and being capable of being switched between a working position, in which said milling device is in operative contact with the ground surface, and a maneuvering position, in which said milling device is not in operative contact with the ground surface, wherein the drive device comprises a drive control unit which controls the driving power of the drive device, and further wherein the ground milling machine comprises a ground milling machine control unit, which ground milling machine control unit controls the cooperation of said drive device, said transportation means and said milling device in the working position and in the maneuvering position such that the driving power of said drive device is automatically reduced in the maneuvering position of said milling device with respect to the driving power of said drive device in the working position of said milling device whilst maintaining at least sufficient driving power for driving said transportation means.

2. The ground milling machine according to claim 1, wherein said drive device provides maximum driving power in the working position of said milling device, and further wherein said drive device provides a fraction of the maximum driving power in the maneuvering position of said milling device, which fraction is at least sufficient for the transmission of driving power to said transportation means and any implements to be powered in the maneuvering phase.

3. The ground milling machine according to claim 2, wherein said ground milling machine control unit controls said drive device such that said fraction of the driving power of said drive device in the maneuvering position of said milling device is equal to less than 50% of the maximum driving power.

4. The ground milling machine according to claim 1, wherein said milling device comprises a rotational speed sensor which cooperates with said ground milling machine control unit, and further wherein said ground milling machine control unit controls the reduction of the driving power in the maneuvering position of the milling device such that the rotational speed of said milling device drops to a fraction of the rotational speed of said milling device in the working position, without dropping below a driving power necessary for the transportation means and any implements to be powered.

5. The ground milling machine according to claim 1, wherein a dynamic torque converter is disposed between said drive device and said milling device which cooperates with said ground milling machine control unit, and which reduces the driving torque for the milling device from a maximum torque to a minimum torque on changing from the working position to the maneuvering position.

6. The ground milling machine according to claim 1, wherein said drive device comprises an emergency clutch throw-out and said milling device has a load torque sensor and/or a rotational speed sensor, and further wherein said emergency clutch throw-out of said drive device and said load torque sensor and/or said rotational speed sensor of said milling device cooperate with said ground milling machine control unit such that when a load torque threshold is exceeded and/or the rotational speed of said milling device drops below a rotational speed threshold in the maneuvering position, said ground milling machine control unit activates an actuator for said emergency clutch throw-out.

7. The ground milling machine according to claim 1, wherein said ground milling machine control unit comprises a power control unit and cooperates with said drive control unit such that the reduced driving power available in the maneuvering position of said milling device is distributable over the necessary implements of said ground milling machine to be powered in the maneuvering operation while maintaining the maneuvering operation.

8. A method for operating a self-propelled ground milling machine for the treatment of ground surfaces , which ground milling machine is equipped with a milling device , a transportation means, and a drive device for driving said transportation means and said milling device, wherein said milling device can be switched between a working position, in which the milling device is in operative contact with the ground surface, and a maneuvering position, in which said milling device is not in operative contact with the ground surface, comprising:

a) lowering the milling device in an initial position of an operational phase from a maneuvering position to a working position with the application of maximum driving power by said drive device for the purpose of advancing the ground milling machine with concurrent milling of a first strip having the width of a milling tool of the milling device from a ground surface to a final position of a first road section to be processed;

b) lifting the milling device under reduced driving power to a maneuvering position of the milling device a maneuvering phase, in which said transportation means returns, by means of the reduced driving power of the drive device, said ground milling machine the initial position with concomitant transversal offset for the purpose of treating a second, adjacent milling strip;

c) repeating the steps a) and b) until a desired width of the road surface has been removed and the milling device is lowered at a new initial position following on the final position of the first road section for processing of a further road section.

9. The method according to claim 8, wherein for the purpose of lowering the driving power to at least that required for powering the transportation means, the fuel supply to said drive device, which comprises an internal combustion engine, is automatically restricted.

10. The method according to claim 8, wherein the rotational speed of the milling device is registered and the reduction of the driving power in the maneuvering position of the milling device is regulated by a drive control unit such that the rotational speed of said milling device is caused to drop to a fraction of the rotational speed of said milling device in the working position, without the driving power dropping below a maximally required driving power for the transportation means.

11. The method according to claim 8, wherein a dynamic torque converter is disposed between said drive device and said milling device, wherein said torque converter is controlled by said ground milling machine control unit, and wherein said dynamic torque converter reduces the driving torque for said milling device from a maximum torque to a minimum torque in the case of a switch-over from the working position to the maneuvering position.

12. The method according to claim 8, wherein a load torque and/or a rotational speed of the milling device are registered, and that when a load torque threshold is exceeded and/or when the rotational speed drops below a rotational speed threshold of the milling device in the maneuvering position, the ground milling machine control unit will activate an actuator for an emergency clutch throw-out.

13. The ground milling machine according to claim 2, wherein said ground milling machine control unit controls said drive device such that said fraction of the driving power of said drive device in the maneuvering position of said milling device is equal to less than 40% of the maximum driving power.

14. The ground milling machine according to claim 2, wherein said ground milling machine control unit controls said drive device such that said fraction of the driving power of said drive device in the maneuvering position of said milling device is equal to less than 30% of the maximum driving power.

* * * * *